US010234231B2

(12) United States Patent
Gianelloni, III et al.

(10) Patent No.: US 10,234,231 B2
(45) Date of Patent: Mar. 19, 2019

(54) FLASH SIGNATURE HIDER

(71) Applicant: Morreau Combat, LLC, Vancleave, MS (US)

(72) Inventors: Max A. Gianelloni, III, Vancleave, MS (US); David Russell Morreau, Wilmer, AL (US)

( * ) Notice: Subject to any disclaimer, the term of this patent is extended or adjusted under 35 U.S.C. 154(b) by 0 days.

(21) Appl. No.: 15/913,514

(22) Filed: Mar. 6, 2018

(65) Prior Publication Data

US 2019/0017769 A1 Jan. 17, 2019

Related U.S. Application Data

(60) Provisional application No. 62/471,399, filed on Mar. 15, 2017.

(51) Int. Cl.
*F41A 21/34* (2006.01)

(52) U.S. Cl.
CPC ..... *F41A 21/34* (2013.01)

(58) Field of Classification Search
CPC ..... F41A 21/34; F41A 21/32; F41A 21/325; F41A 21/36; F41A 21/38; F41A 21/40; F41A 21/42
USPC ..... 89/14.2, 14.3, 14.4, 14.5
See application file for complete search history.

(56) References Cited

U.S. PATENT DOCUMENTS 1,341,363 A * 5/1920 Fiala ..... F41A 21/30 181/223
1,342,978 A * 6/1920 Young ..... F41A 21/30 181/223
1,667,186 A * 4/1928 Bluehdorn ..... F41A 21/30 181/223
1,901,138 A * 3/1933 Barnes ..... F41A 21/30 89/14.3
2,503,491 A * 4/1950 Janz ..... F41A 21/30 181/223
2,514,996 A * 7/1950 Faust, Jr. ..... F41A 21/30 181/223
2,765,706 A * 10/1956 Strohl ..... F41A 21/36 89/14.3
3,409,232 A * 11/1968 Cholin ..... A62C 13/006 169/11
3,500,955 A * 3/1970 Werbell ..... F41A 21/30 181/223
3,667,570 A * 6/1972 WerBell, III ..... F41A 21/30 181/223
4,207,799 A 6/1980 Tocco
4,454,798 A * 6/1984 Shea ..... F41A 21/30 181/223
4,530,417 A * 7/1985 Daniel ..... F41A 21/30 181/223
4,907,488 A * 3/1990 Seberger ..... F41A 21/30 181/223

(Continued)

*Primary Examiner* — Joshua E Freeman
(74) *Attorney, Agent, or Firm* — Tanner IP, PLLC

(57) ABSTRACT

Flash suppressors having at least one contracting and then expanding burn chamber are described. The contracting and then expanding burn chamber may include one or more ribbed surfaces that enhance burning of propellant gasses and ambient oxygen before the gasses exit the flash suppressor. In some examples, a burn chamber may include a spirally threaded inner and/or outer surface, which swirls and cools the propellant gasses to enhance burning before the propellant gasses exit from the flash suppressor.

21 Claims, 10 Drawing Sheets

(56) References Cited

U.S. PATENT DOCUMENTS 4,974,489 A * 12/1990 Fishbaugh ..... F41A 21/30 89/14.4
5,029,512 A * 7/1991 Latka ..... F41A 21/30 181/223
5,136,923 A * 8/1992 Walsh, Jr. ..... F41A 21/30 89/14.2
5,773,746 A 6/1998 Vaden
6,308,609 B1 * 10/2001 Davies ..... F41A 21/30 181/223
6,837,139 B2 1/2005 Meyers
7,073,426 B1 7/2006 White
7,600,606 B2 * 10/2009 Brittingham ..... F41A 21/30 181/223
7,836,809 B2 11/2010 Noveske
8,047,115 B2 11/2011 Noveske
8,061,254 B2 11/2011 Heath
8,087,338 B1 * 1/2012 Hines ..... F41A 21/30 181/223
8,424,635 B1 4/2013 Klawunn
8,528,691 B1 * 9/2013 Carmichael ..... F41A 21/30 181/223
8,561,757 B1 * 10/2013 Edsall ..... F41A 21/30 181/223
8,807,272 B2 * 8/2014 Bladen ..... F41A 21/30 181/223
8,844,422 B1 * 9/2014 Klett ..... F41A 21/30 89/14.2
8,875,612 B1 * 11/2014 Klett ..... F41A 21/30 89/14.4
8,967,325 B1 * 3/2015 Cronhelm ..... F41A 13/00 181/223
8,991,551 B2 * 3/2015 Latka ..... F41A 21/30 181/223
9,163,891 B1 10/2015 Dater et al.
9,441,901 B1 * 9/2016 Harrison ..... F41A 21/36
9,459,065 B2 10/2016 Palu
9,709,354 B2 7/2017 Larue
9,835,399 B1 * 12/2017 Lessard ..... F41A 21/34
10,060,695 B2 * 8/2018 Slack ..... F41A 21/30
2003/0145718 A1 * 8/2003 Hausken ..... F41A 21/30 89/14.4
2006/0123983 A1 * 6/2006 Vais ..... F41A 21/30 89/14.4
2010/0126334 A1 * 5/2010 Shults ..... F41A 21/30 89/14.4
2010/0180759 A1 * 7/2010 Petersen ..... F41A 21/30 89/14.4
2010/0275493 A1 * 11/2010 Polovnev ..... F41A 21/34 42/90
2013/0168181 A1 * 7/2013 Wirth ..... F41A 21/30 181/223
2014/0216237 A1 * 8/2014 Butler ..... F41A 21/36 89/14.4
2015/0184968 A1 * 7/2015 Fischer ..... F41A 21/30 89/14.4
2015/0192379 A1 * 7/2015 Larson, Jr. ..... F41A 3/66 89/14.3
2015/0354422 A1 * 12/2015 Liskey ..... F41A 21/30 89/14.4
2017/0030672 A1 * 2/2017 Larue ..... F41A 21/30
2017/0067711 A1 * 3/2017 Slack ..... F41A 21/30
2017/0205175 A1 * 7/2017 Garst ..... F41A 21/30
2017/0307323 A1 * 10/2017 Couvillion ..... F41A 21/34
2018/0023914 A1 * 1/2018 Latka ..... F41A 21/30 89/14.4
2018/0038663 A1 * 2/2018 Larue ..... F41A 3/66
2018/0058789 A1 * 3/2018 Dome ..... F41A 21/30
2018/0266783 A1 * 9/2018 Morreau ..... F41A 21/34
2018/0292164 A1 * 10/2018 Thompson ..... F41A 21/325
2018/0306543 A1 * 10/2018 Tertin ..... F41A 21/325

* cited by examiner

FLASH SIGNATURE HIDER

RELATED APPLICATIONS

This application claims priority to U.S. Provisional Application No. 62/471,399 filed Mar. 15, 2017 and entitled "FLASH SUPRESSOR," the contents of which are hereby incorporated herein by reference.

BACKGROUND

The present subject matter relates to the field of firearms, and more specifically, to flash suppressors for firearms.

There are a number of different accessories that may be mounted to the end of a firearm barrel for different effects. One example of such accessories are commonly referred to as muzzle brakes, which are used to reduce upward movement of the barrel (muzzle climb) and/or rearward movement of the barrel (recoil) during firing by allowing propellant gasses to forcefully exit the muzzle brake, typically through voids or gas ports, in a specified upward and/or rearward direction. For example, U.S. Pat. No. 4,207,799 by Tocco depicts a number of different muzzle brakes consisting of tubular bodies with ports that allow gasses to escape in a generally upward manner.

Sound suppressors, or silencers, are used to reduce the noise signature generated when firing a weapon. Noise suppression is desirable for various reasons including stealth and protecting the shooter and observers from hearing damage. Sound suppressors typically use a number of internal baffles or partitions that are connected to, or engaged with, an outer tube of the suppressor, and positioned in a longitudinally spaced relation. There is a central opening in each of the baffles that allows an inner tube, or a bullet, to pass through the suppressor. A number of chambers or compartments are defined between the baffles, and the propellant gas is allowed to progress through each of the chambers via ports in the baffles and/or via central openings. Such configurations can be relatively costly to manufacture, and difficult to assemble and/or disassemble. Moreover, they usually require a significant amount of maintenance due to fouling of the baffles, chambers and/or threads of the suppressor by accumulation of cartridge powder residue. U.S. Pat. No. 8,424,635 describes a firearm suppressor including an outer housing and a baffle stack mounted inside the outer housing.

Flash hiders may also be used to reduce the flash of burning gas and propellant that exits the barrel during firing. For example, U.S. Pat. No. 8,061,254 to Heath describes a flash suppressor for use with a firearm including a plurality of "perforations" or gas vents, arranged around the upper portion of the device, that allow propellant gas to exit and ignite.

These accessories may be attached to a firearm barrel via threading that is provided at the end of the firearm barrel. They may also be attached to one another, such as attaching a silencer to a flash hider or muzzle brake that is directly attached to the firearm barrel. For example, U.S. Pat. No. 5,773,746 to Vaden describes a coupler for attaching a noise suppressor, or silencer to a firearm flash hider.

Despite advances in the art, there are still needs for improved flash suppressors that effectively reduce the flash of a firearm without the expensive production costs and without the difficult assembly, disassembly, attachment, detachment and cleaning procedures common in the field.

SUMMARY

This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter.

According to first aspects of the disclosure, a firearm flash suppressor may include a proximal end, which may be configured to attach the flash suppressor to a firearm muzzle, flash hider, and/or muzzle brake, and a distal end including a first opening for allowing a bullet to exit the flash suppressor and/or a second opening for allowing gas to exit the flash suppressor. Embodiments may include an inner tube disposed between the proximal end and the distal end, with a passage configured to allow the bullet to travel through the flash suppressor, and/or an outer tube disposed between the proximal end and the distal end, and at least partially surrounding the inner tube.

In embodiments, an outer surface of the inner tube and an inner surface of the outer tube may at least partially define a burn chamber configured to allow burning of a gas exiting from the firearm, e.g. exiting the firearm muzzle, flash hider, muzzle brake, etc.

In embodiments, at least one of the outer surface of the inner tube or the inner surface of the outer tube may include a contour that changes a cross-sectional area of the burn chamber.

In embodiments, the proximal end may include a base cap configured to attach to a standard fitting included in the at least one of a firearm muzzle, flash hider, or muzzle brake, and configured to attach to and detach from the outer tube.

In embodiments, the proximal end may be configured to attach to a muzzle brake, and gas enters the flash suppressor via side ports included in the muzzle brake.

In embodiments, the distal end may include an end cap configured to attach to and detach from the outer tube, the end cap including an outlet port configured to allow gas from the burn chamber to exit the flash suppressor.

In embodiments, the inner tube may be configured to attach to and detach from the end cap via threading within the first opening.

In embodiments, the inner tube may be configured to seat securely against the firearm muzzle, flash hider, or muzzle brake, and to fixedly align center axes of the passage and the firearm muzzle, flash hider, or muzzle brake.

In embodiments, the passage of the inner tube may have a substantially uniform cross-section.

In embodiments, a thickness of the inner tube may change over a length of the burn chamber, with the change in thickness of the inner tube at least partially causing a reduction and an expansion of the cross-sectional area of the burn chamber.

In embodiments, a thickness of the outer tube may change over a length of the burn chamber, with the change in thickness of the outer tube at least partially causing a reduction and expansion of the cross-sectional area of the burn chamber.

In embodiments, the outer sleeve may include an insulating material between the inner surface of the outer sleeve and an outer surface of the outer tube.

In embodiments, at least one of the outer surface of the inner tube or the inner surface of the outer tube may include a ribbed surface.

In embodiments, the burn chamber may include a plurality of reverse jets formed by the change of the cross-sectional area of the burn chamber.

In embodiments, the burn chamber may include a spiral contour configured to swirl gas passing through the burn chamber.

In embodiments, the burn chamber may be free of baffles.

According to further aspects of the disclosure, a firearm flash suppressor may include one or more of an inner tube including a passage configured to allow a bullet to travel through the flash suppressor; an outer tube configured to at least partially surround the inner tube and to form a burn chamber between the inner tube and the outer sleeve; a base cap attached to the outer tube and configured to attach the flash suppressor to a firearm muzzle, flash hider, or muzzle brake; and/or an end cap attached to the outer tube and the inner tube, the end cap including an exhaust port in fluid communication with the burn chamber for allowing gas to exit the flash suppressor.

In embodiments, the inner tube may be configured to seat securely against a firearm muzzle, flash hider, or muzzle brake, and to fixedly align center axes of the passage and the firearm muzzle, flash hider, or muzzle brake.

In embodiments, the passage of the inner tube may have a substantially uniform cross-section, and a thickness of the inner tube and/or the outer tube may change over a length of the burn chamber to change a cross-sectional area of the burn chamber.

In embodiments, the base cap may be removably attached to the outer tube via a first set of cooperating threads included in the base cap and the outer tube, the end cap may be removably attached to the outer tube via a second set of cooperating threads included in the end cap and the outer tube, and the end cap may be removably attached to the inner tube via a third set of cooperating threads included in the end cap and the inner tube.

In embodiments, the base cap may be configured to attach to a muzzle brake, and include at least one inlet port configured to allow gas from the muzzle brake to enter the burn chamber.

In embodiments, the thickness of the inner tube may change over the length of the burn chamber.

In embodiments, the thickness of the outer tube may change over the length of the burn chamber.

In embodiments, the thicknesses of the inner tube and the outer tube both change over the length of the burn chamber.

In embodiments, the outer tube may be configured in a manner that prevents gas from escaping the flash suppressor anywhere along the length of the outer tube.

According to further aspects of the disclosure, a firearm flash suppressor may include one or more of an inner tube including a passage configured to allow a bullet to travel through the flash suppressor; an outer tube configured to at least partially surround the inner tube and to form a burn chamber between the inner tube and the outer tube; a base cap attached to the outer tube and configured to attach the flash suppressor to a firearm muzzle, flash hider, or muzzle brake; and/or an end cap attached to the outer tube and the inner tube.

In embodiments, the inner tube may be configured to seat securely against the firearm muzzle, flash hider, or muzzle brake, and to fixedly align center axes of the passage and the firearm muzzle, flash hider, or muzzle brake.

In embodiments, the passage of the inner tube may have a substantially uniform cross-section, and a thickness of the inner tube may change over a length of the burn chamber to change a cross-sectional area of the burn chamber.

In embodiments, an outer surface of the inner tube may include a plurality of circumferential ridges along the length of the burn chamber.

In embodiments, a thickness of the outer tube may be substantially uniform along the length of the burn chamber.

In embodiments, the outer tube may be configured in a manner that prevents gas from escaping the flash suppressor anywhere along the length of the outer tube.

Other embodiments may include methods of manufacturing a flash suppressor as described herein, and various methods of using such devices.

These and other aspects of the invention will now become apparent to those of ordinary skill in the art upon review of the following description of embodiments of the invention in conjunction with the accompanying drawings.

BRIEF DESCRIPTION OF THE DRAWINGS

So that the manner in which the above-recited features of embodiments can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
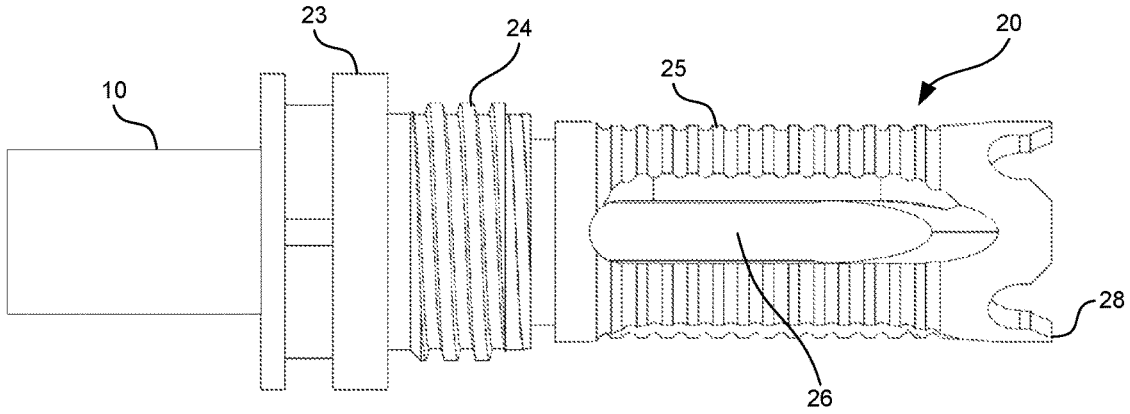
FIG. 1 (Related Art)
FIGS. 1-3 depict a related art muzzle brake.

It is to be expressly understood that the description and drawings are only for the purpose of illustrating certain embodiments of the invention and are an aid for understanding. They are not intended to be a definition of the limits of the invention.

DETAILED DESCRIPTION

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a port" is a reference to one or more ports and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Terms of degree may be used to describe various features of the disclosure, and may be interpreted as follows, unless otherwise specified. As used herein, the term "substantially" may be interpreted as greater than 75%, and the term "approximately" may be interpreted as ±10%.

As used herein, a "gas" may be understood as a gas/propellant mixture that commonly follows a bullet as it travels through and exits the barrel of a firearm.

As discussed herein, aspects of the disclosure may generally describe a flash suppressor having a receiving chamber for receiving hot gases from a firearm when a bullet is fired, and at least one contracting and then expanding chamber in fluid communication with the receiving chamber. The contracting and then expanding chamber may include at least one rippled or ribbed surface to assist with mixing of the gasses and any ambient oxygen, which leads to enhanced burning of the propellant gasses. Embodiments may also include a spiral chamber which circulates the propellant gasses to allow for the complete burning thereof in a spiraling fashion before exiting from vents provided in the flash suppressor end cap.

Figure 2:
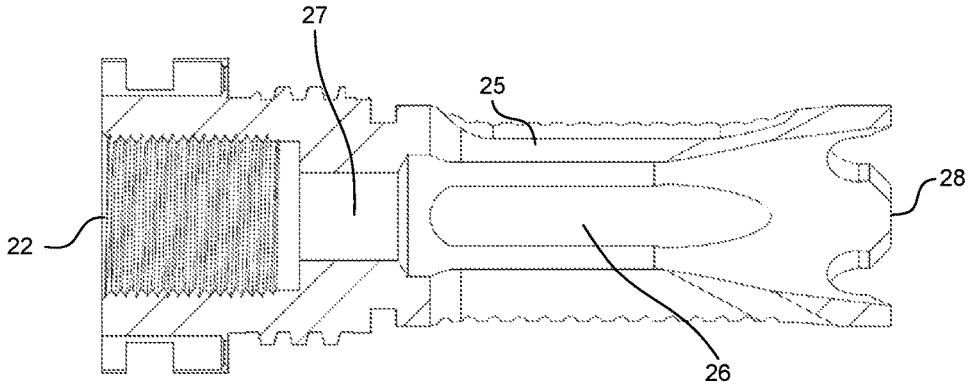
FIG. 2 (Related Art)
Figure 3:
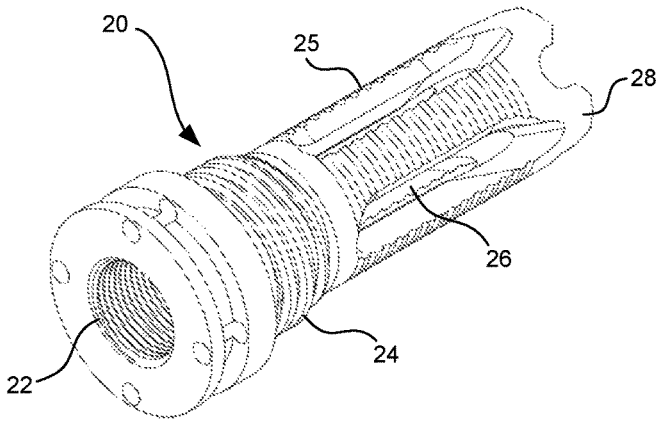
FIG. 3 (Related Art)

FIGS. 1-3 depict a muzzle brake 20 that may be attached to the end of a firearm barrel 10. The muzzle brake 20 includes muzzle brake barrel threads 22, muzzle brake attachment threads 24, muzzle brake sidewalls 25, and muzzle brake side ports 26. The muzzle brake 20 may be attached to the firearm barrel 10 using conventional means, such as barrel threads (shown in FIG. 11). The muzzle brake attachment lip 23 may be used to attach a blank firing adapter (BFA) or other accessories, and may include a nut-shaped portion for using a wrench to securely attach and remove the muzzle brake 20 from firearm barrel 10. The muzzle brake attachment threads 24 may be used to attach accessories, such as sound and noise suppressors, to the muzzle brake. When the firearm is fired, propellant gas exits the various muzzle brake side ports 26.

For the sake of convenience and easy understanding, the muzzle brake 20 is used as an exemplary attachment point for flash suppressors described herein. However, other attachment means are also possible including, for example, using differently configured muzzle brakes and/or flash hiders, clamps, and/or direct attachment to the firearm barrel 10.

Figure 4:
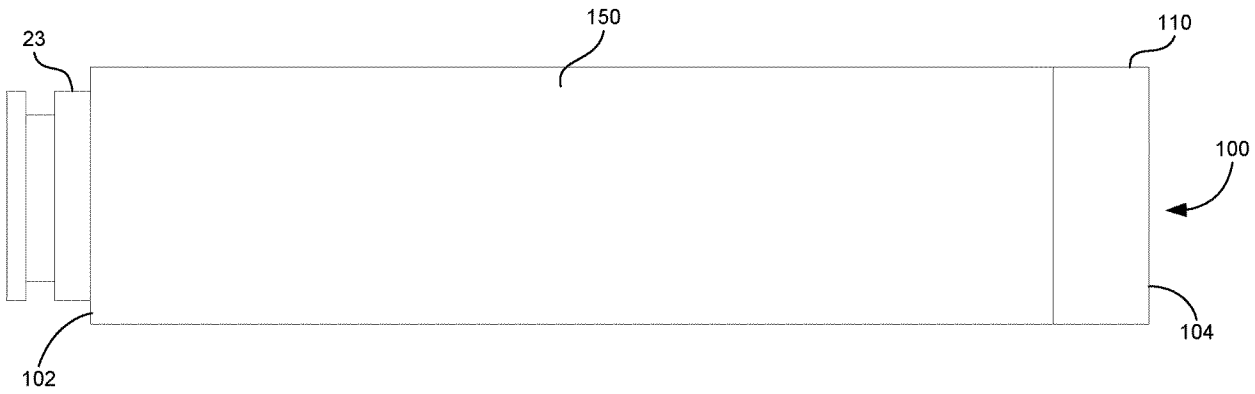
FIG. 4 depicts an exterior view of an exemplary flash suppressor according to aspects of the invention.

Turning to FIG. 4, an exemplary firearm flash suppressor 100 is shown. The flash suppressor 100 includes an outer tube 150, and an end cap 110 at the distal end 104 of the flash suppressor. As used herein, the term "distal end" of the flash suppressor should be understood as the end farthest away from the firearm barrel, and the "proximal end" of the flash suppressor should be understood as the end at which the flash suppressor is attached to the firearm. The muzzle brake attachment lip 23 from the muzzle brake 20, shown in FIGS. 1-3, can also be seen at the proximal end 102 of the flash suppressor in FIG. 4.

Figure 5:
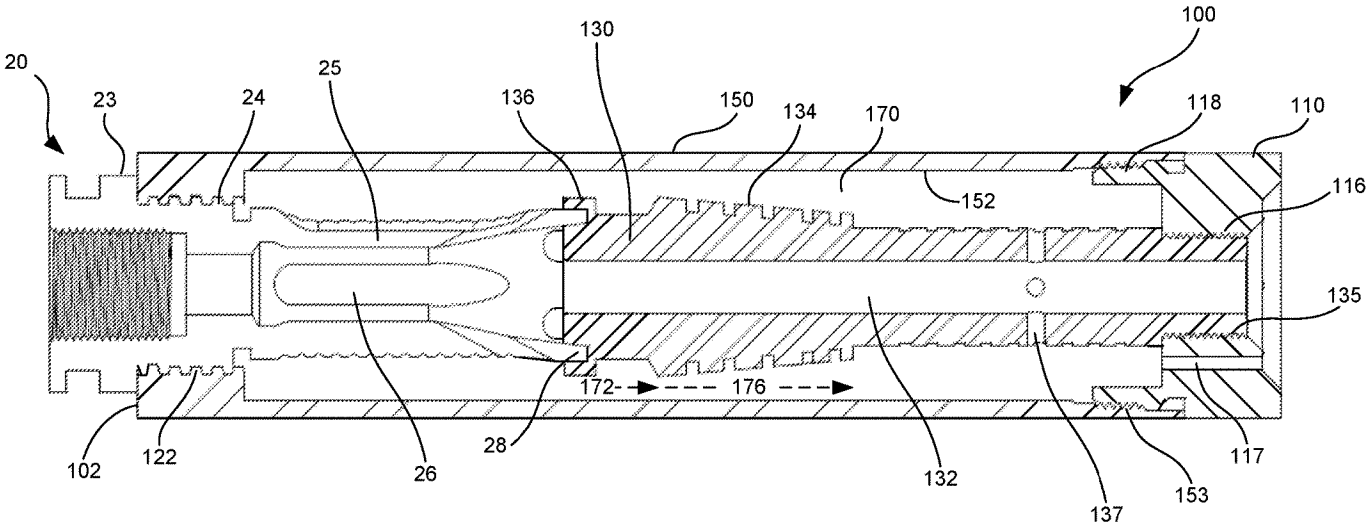
FIG. 5 is a cross-sectional view including further details of the exemplary flash suppressor shown in FIG. 4.

FIG. 5 is a cross-sectional view of the flash suppressor 100 shown in FIG. 4. As can be seen in FIG. 5, the flash suppressor 100 is attached at the proximal end 102 to the muzzle brake 20 via outer tube threads 122 that engage with the muzzle brake attachment threads 24.

An inner tube 130 engages with the muzzle brake distal end 28 via an annular (or otherwise shaped) groove in stabilizing portion 136. The inner tube 130 includes a passage 132, which a bullet can pass through and then out of the distal end of the flash suppressor 100. In embodiments, the passage 132 can be a smooth bore that allows the bullet to pass through the flash suppressor without the turbulence, internal shock waves, or other destabilizing effects of a bullet passing by the ports, internal baffles and/or chambers of some conventional sound and/or flash suppressors. The avoidance of such effects can improve the accuracy of firearms using flash suppressors as described herein, compared to firearms using similarly sized sound suppressors and/or any equally effective flash suppressors.

As discussed further herein, the engagement of the stabilizing portion 136 with the muzzle brake distal end 28 helps ensure alignment of the passage 132 and the bore of the firearm, even when the inner tube 130 is heated during firing.

The distal end 104 of the flash suppressor 100 includes an end cap 110 that is secured to the outer tube 150 via outer tube threads 153 and end cap outer threads 118. The end cap 110 is also secured to the inner tube 130 via inner tube threads 135 and end cap interior threads 116.

Thus, the exemplary flash suppressor 100 shown in FIG. 5 can be implemented using only three components that are relatively easy to manufacture, assemble and disassemble. Such configurations may also avoid the use of baffles, or other objects connected to or engaged with the inner surface 152 of the outer tube 150 and/or the inner surface 152 of the outer tube 150.

Between the inner surface 152 of the outer tube 150 and the outer surface 134 of the inner tube 130 is a void 170 which may be referred to as a "burn chamber." In operation, propellant gas may exit the muzzle brake side ports 26 and enter the burn chamber 170 as the bullet exits the muzzle brake 20 and enters the passage 132 of the inner tube 130. The propellant gas travels past a narrowing portion 172 and through an expanding portion 176. As used herein, a narrowing portion of a burn chamber refers to an area in which the cross-section of the burn chamber is reduced, and an expanding portion of a burn chamber refers to an area in which the cross-section of the burn chamber is increased. The combination of a narrowing portion and an expanding portion can form a reverse jet that decreases the speed of the propellant gas traveling through the burn chamber 170.

In the embodiment shown in FIG. 5, the expanding and narrowing of the burn chamber 170 is achieved by changes in the thickness of the inner tube 130 including a steep angle change toward the right (distal) side of narrowing portion 172, and a more gradual trend progressing through the expanding portion 176 (irrespective of the grooves discussed further below). The inner surface 152 of the outer tube 150 is smooth, which can also aid in the ease of manufacturing the outer tube 150.

Figure 8:
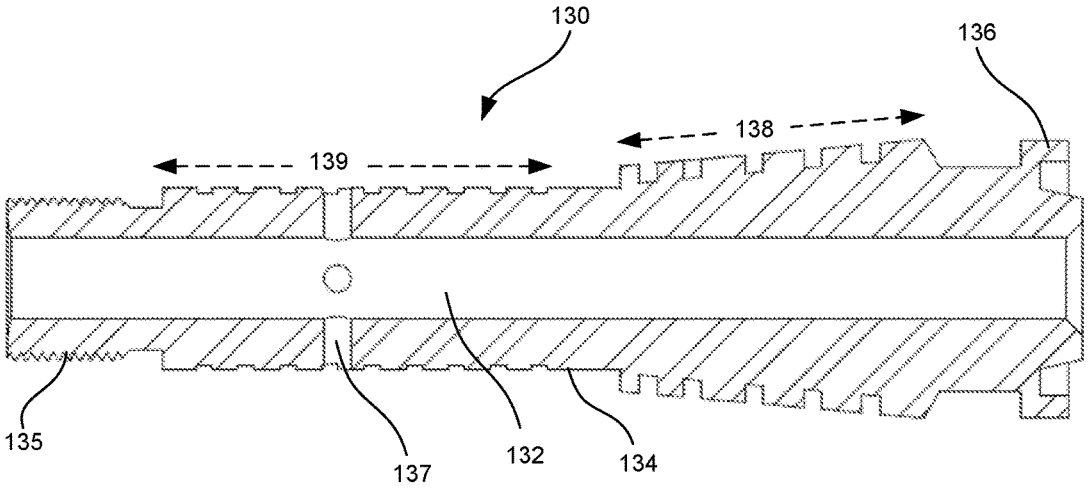
FIG. 8 is a cross-sectional view showing additional details of an inner tube included in the flash suppressor shown in FIG. 4.
Figure 9:
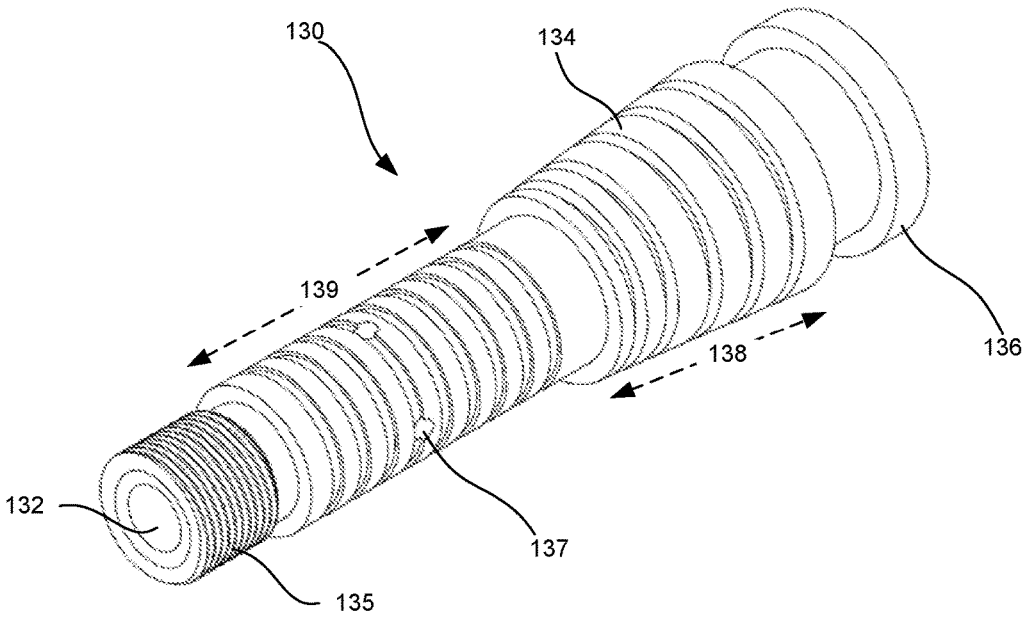
FIG. 9 is an isometric perspective view showing additional outer surface details of the inner tube shown in FIG. 8.

The inner tube 130 also includes a plurality of annular indentations or grooves on the outer surface 134, which can be seen more clearly and FIGS. 8 and 9. These grooves can facilitate, among other objects, disruption of the laminar flow of propellant gas, inducing turbulent flow and mixing of the propellant gas with ambient oxygen in the burn chamber. It is noted that a turbulent flow inducing pattern may take various forms and is not limited to the grooves shown on inner tube 130. For example, variously shaped ridges, ripples, dimples, indentations, and/or surface treatments may be incorporated on an inner (or outer) tube to achieve a similar effect.

In embodiments, the turbulent flow inducing pattern, such as the ribbed surface in expanding portion 176, may be designed such that the pattern features stick no further than 10%, 20%, or 30% of the way into the burn chamber.

As also shown in FIG. 5, the inner tube 130 may include one or more inner tube ports 137 that allow fluid communication between the passage 132 and the burn chamber 170. Such ports can be advantageous in equalizing pressure between the burn chamber 170 and the passage 132, e.g. as the bullet passes the inner tube ports 137 and exits the flash suppressor at the distal end 104. In some examples, more than one port or set of ports may be disposed at different locations along the length of passage 132.

End cap 110 may also include one or more end cap ports 117 in fluid communication with the burn chamber 170 that allow propellant gas to exit the burn chamber 170. In some examples, the distal ends of the end cap ports 117 may be chamfered, or otherwise shaped to further control the propellant gas, such as dispersing and/or directing the propellant gas to reduce muzzle flash from the shooter's perspective, directing noise away from the shooter's ears, providing a muzzle brake effect, and/or further reducing the propellant gas plume.

It is also noted that, for purposes of manufacturing a flash suppressor that is attached directly to the firearm barrel, thereby omitting the muzzle brake 20 or other intermediate attachment mechanism, an outer tube, such as element 150, or a base cap, as discussed further herein, may be configured to include barrel threads like the barrel threads 22 of the muzzle brake 20, an inner tube stabilizing means similar to the muzzle brake distal end 28, and ports like muzzle brake side ports 26 to allow propellant gas to enter the burn chamber 170.

Figure 6:
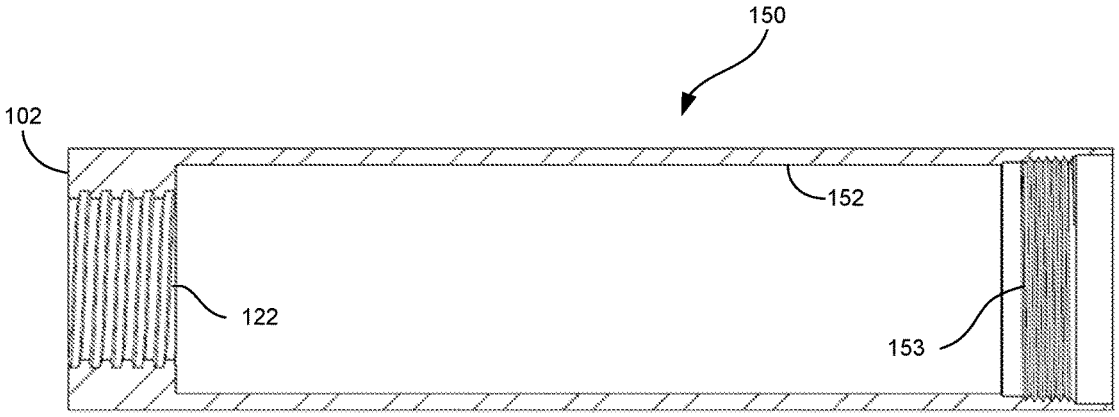
FIG. 6 is a cross-sectional view of an outer tube included in the flash suppressor shown in FIG. 4.

FIG. 6 is a cross-sectional view, showing additional details of the outer tube 150. As can be seen in FIG. 6, the outer tube 150 includes outer tube threads 122 at the proximal end 102, and outer tube threads 153 at the opposite end of the outer tube 150. As discussed above, the outer tube threads 122 are configured to engage with the muzzle brake attachment threads 24, and the outer tube threads 153 are configured to engage with the end cap outer threads 118. The inner surface 152 of the outer tube 150 may be a smooth cylindrical surface. However, as discussed further below, other embodiments may include contours to other outer tubes' inner surfaces.

The outer tube 150 may be configured to prevent gas from escaping from the flash suppressor along all or part of the burn chamber 170. For example, the outer tube 150 may be constructed of a piece of pipe without any venting between the outer tube threads 122 and 153.

Figure 7:
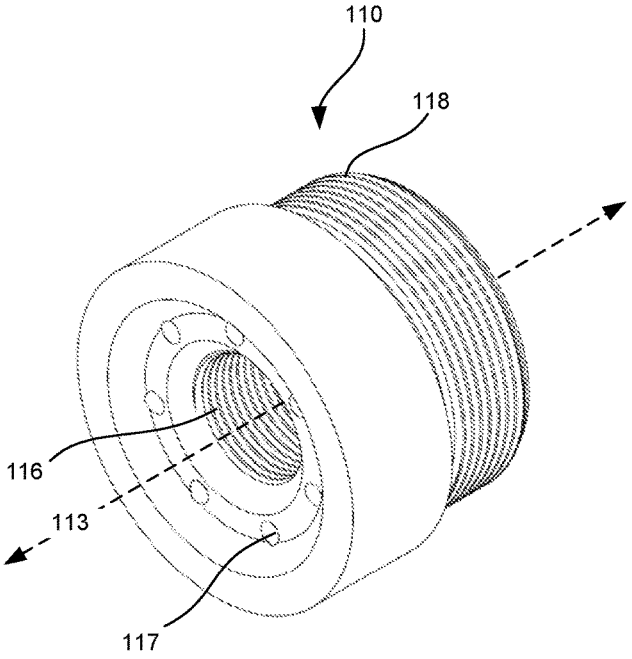
FIG. 7 is an isometric perspective view of an end cap included in the flash suppressor shown in FIG. 4.

FIG. 7 is an isometric perspective view of end cap 110. As shown in FIG. 7, end cap 110 includes end cap outer threads 118, and end cap interior threads 116 disposed in end cap opening 113. End cap outer threads 118 are configured to engage with the outer tube threads 153, and end cap interior threads 116 are configured to engage with inner tube threads 135. End cap 110 also includes a plurality of end cap ports 117, which allow propellant gas to exit the flash suppressor 100 via burn chamber 170. Positioning these ports in a recessed portion of the end cap, facing away from the user, can be advantageous in many ways, including shielding the shooter's eyes from any remaining light plume, and directing the report sound away from the shooter's ears. In some examples, the openings of end cap ports 117 may be chamfered, e.g. to disperse the propellant gas, or directionally shaped, e.g. to guide the propellant gas toward, or away from, the end cap opening 113.

FIG. 8 is an expanded cross-sectional view of inner tube 130. As shown in FIG. 8, the inner tube 130 includes stabilizing portion 136, in this case an annular groove around the proximal end of the inner tube. Inner tube 130 further includes inner tube threads 135 configured to engage with end cap interior threads 116. As can also be seen in FIG. 8, inner tube 130 includes ribbed surfaces 138 and 139. As mentioned above, these surfaces can beneficially induce turbulent flow in the propellant gas to promote rapid burning of the propellant material within the burn chamber, thereby significantly reducing the amount of burning propellant gas that exits the flash suppressor.

FIG. 9 is an isometric perspective view of the inner tube 130. As shown in FIG. 9, the overall width of the inner tube 130 gradually decreases along the length of the ribbed surface 138 (notwithstanding the recessed ribs included therein), thereby expanding the portion of the burn chamber surrounding this portion. The overall width of the inner tube 130 remains approximately constant along the length of the ribbed surface 139 (notwithstanding the recessed ribs included therein).

Figure 10:
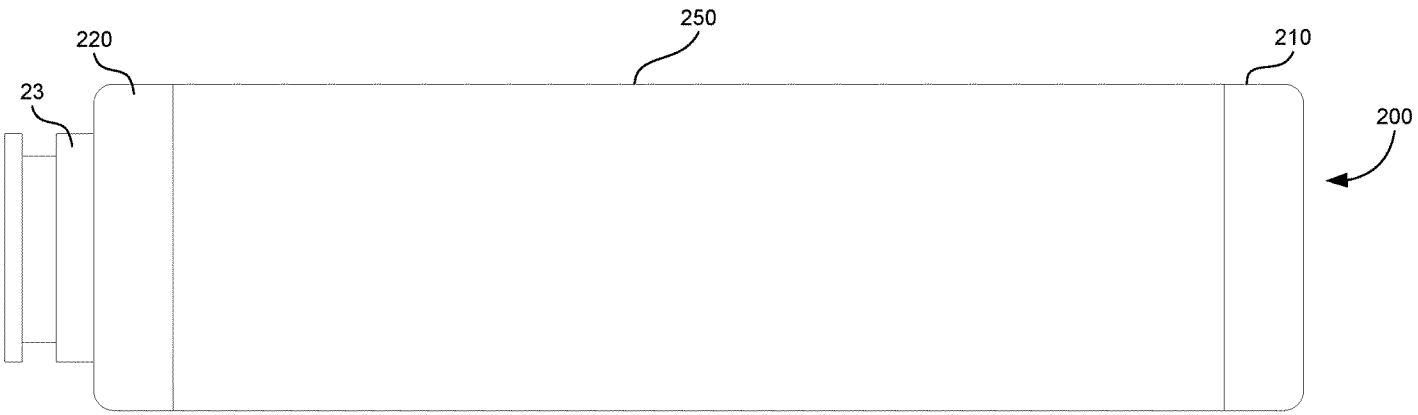
FIG. 10 depicts an exterior view of another exemplary flash suppressor according to aspects of the invention.

Turning to FIG. 10, another exemplary firearm flash suppressor 200 is shown. The flash suppressor 200 includes an outer tube 250, an end cap 210 at the distal end of the flash suppressor, and a base cap 220 at the proximal end of the flash suppressor. The muzzle brake attachment lip 23 from the muzzle brake 20, shown in FIGS. 1-3, can also be seen extending from the base cap 220 of the flash suppressor in FIG. 10.

Figure 11:
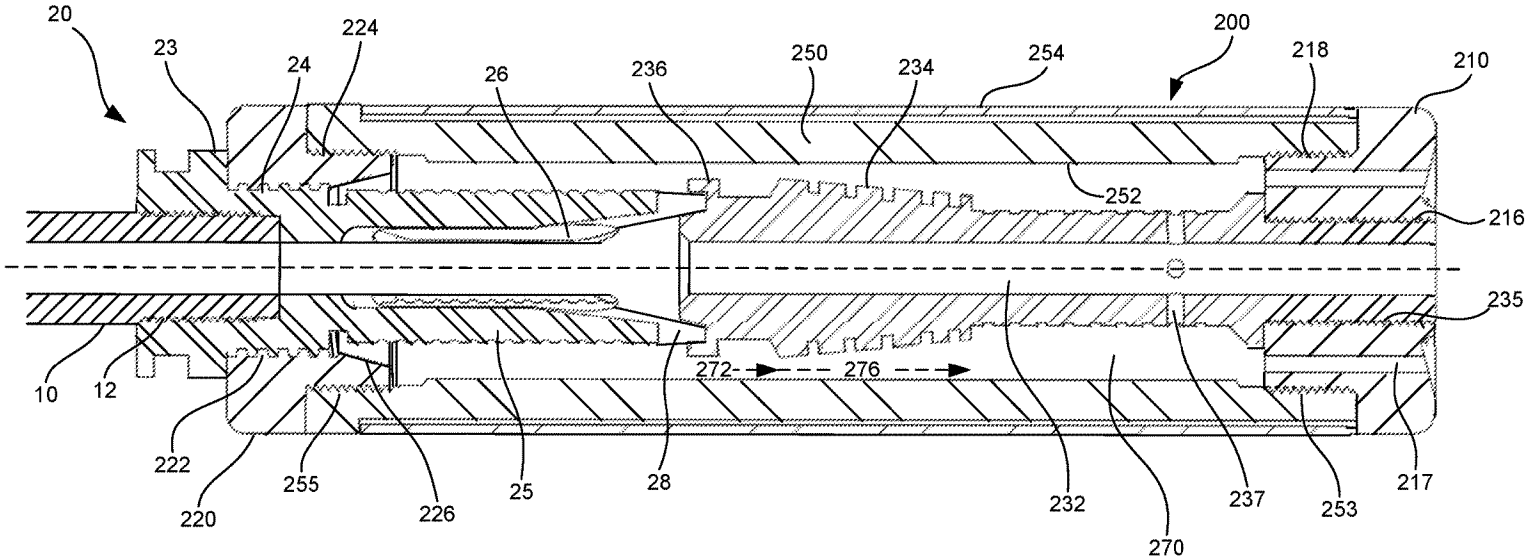
FIG. 11 is a cross-sectional view including further details of the exemplary flash suppressor shown in FIG. 10.

FIG. 11 is a cross-sectional view of the flash suppressor 200 shown in FIG. 10. As can be seen in FIG. 11, the muzzle brake 20 is attached to firearm barrel 10 via muzzle brake barrel threads 22 that engage with the barrel threads 12. Flash suppressor 200 is attached to the muzzle brake 20 via base cap inner threads 222 that engage with the muzzle brake attachment threads 24. Base cap 220 may further include base cap outer threads that are configured to engage with outer tube threads 255. The base cap 220 may further include internal surfaces, e.g. inward of the outer tube threads 255, that are shaped to direct propellant gasses escaping from the muzzle brake 20 in a forward direction, into the burn chamber 270. For example, a beveled opening 226 may be configured so that propellant gas is directed from the muzzle brake side ports 26 toward the burn chamber narrowing portion 272. In some examples, the outer sleeve 254 may be fitted to the outer tube 250, or there may be a thermally conductive material between the outer sleeve 254 and the outer tube 250. End cap 210 and/or base cap 220 may include a recessed portion (not shown) that supports and positions the outer sleeve 254, e.g. in embodiments where there is an air gap between the outer sleeve 254 and the outer tube 250.

As with the embodiment shown in FIGS. 4-9, the flash suppressor 200 includes an inner tube 230 that engages with the muzzle brake distal end 28 via an annular (or otherwise shaped) groove in stabilizing portion 236. The inner tube 230 includes a passage 232 through which a bullet can pass through and out of the distal end of the flash suppressor 200. In embodiments, the passage 232 can be a smooth bore that allows the bullet to pass through the flash suppressor without the turbulence, internal shock waves, or other destabilizing effects of a bullet passing by the ports, internal baffles and/or chambers of some conventional sound and/or flash suppressors.

The engagement of the stabilizing portion 236 with the muzzle brake distal end 28 helps ensure alignment of the passage 232 and the bore of the firearm, even when the inner tube 230 is heated during firing.

The flash suppressor 200 further includes an end cap 210 that is secured to the outer tube 250 via outer tube threads 253 and end cap outer threads 218. The end cap 210 is also secured to the inner tube 230 via inner tube threads 235 and end cap interior threads 216.

Thus, the exemplary flash suppressor 200 shown in FIG. 11 can be implemented using only four components that are also relatively easy to manufacture, assemble and disassemble. Such configurations may also avoid the use of baffles, or other objects connected to or engaged with the inner surface 252 of the outer tube 250 and/or the inner surface 152 of the outer tube 150.

In some examples, an outer sleeve 254 may be provided around the inner tube 250. The outer sleeve 254 (and any insulation disposed between the outer sleeve 254 and outer tube 250) may help maintain the exterior of the flash suppressor at a safe temperature, e.g. to avoid burns, and/or reduce the heat signature of the firearm.

The inner surface 252 of the outer tube 250 is substantially smooth, which can also aid in the ease of manufacturing the outer tube 150. It is noted that, although the outer tube 250, and other outer tubes described herein, may be depicted as cylindrical with circular cross-sections, other cross-sectional shapes are also possible, including ovals, squares, rectangles, triangles, hexagons, and various other shapes that a manufacturer may envision.

Between the inner surface 252 of the outer tube 250 and the outer surface 234 of the inner tube 230 is a void 270 which may also be referred to as a "burn chamber." As with the embodiment described above, during operation of the flash suppressor 200, propellant gas may exit the muzzle brake side ports 26 and enter the burn chamber 270 as the bullet exits the muzzle brake 20 and enters the passage 232 of the inner tube 230. The propellant gas travels past a narrowing portion 272 and through an expanding portion 276. Again, the combination of a narrowing portion and an expanding portion can form a reverse jet that decreases the speed of the propellant gas traveling through the burn chamber 270.

Figure 15:
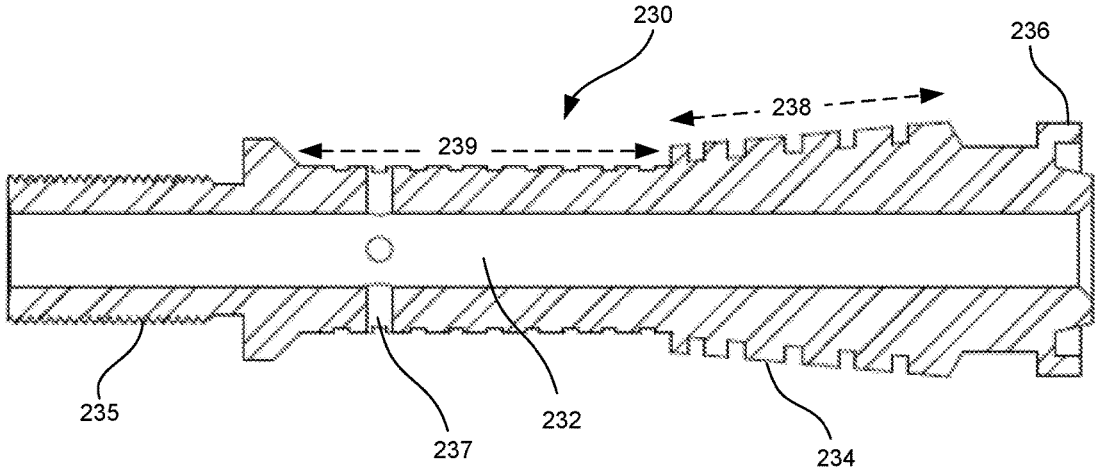
FIG. 15 is a cross-sectional view showing additional details of an inner tube included in the flash suppressor shown in FIG. 10.
Figure 16:
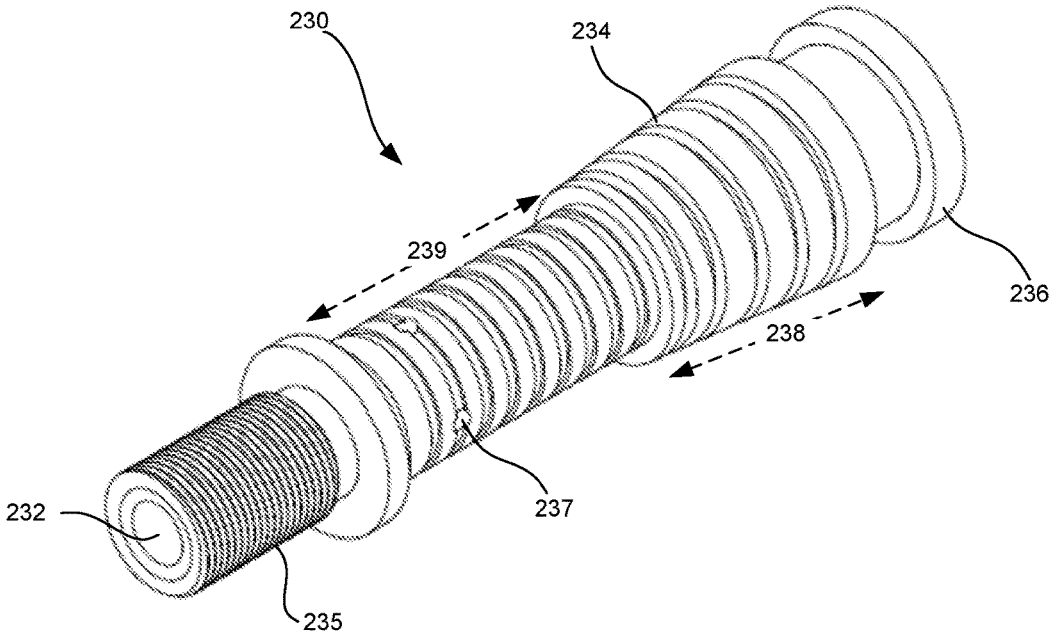
FIG. 16 is an isometric perspective view showing additional outer surface details of the inner tube shown in FIG. 15.

The inner tube 230 also includes a plurality of annular indentations or grooves on the outer surface 234, which can be seen more clearly and FIGS. 15 and 16. These grooves can facilitate, among other objects, disruption of the laminar flow of propellant gas, inducing turbulent flow and mixing of the propellant gas with ambient oxygen in the burn chamber.

As also shown in FIG. 11, the inner tube 230 may include one or more inner tube ports 237 that allow fluid communication between the passage 232 and the burn chamber 270. Such ports can be advantageous in equalizing pressure as the bullet passes the ports 237 and exits the flash suppressor at the distal end via opening 213 in the end cap.

End cap 210 may also include one or more end cap ports 217 in fluid communication with the burn chamber 270 that allow propellant gas to exit the burn chamber 270. As with the previously described embodiment, the distal ends of the end cap ports may be chamfered, or otherwise shaped to further control the propellant gas, such as dispersing and/or directing it to provide a muzzle brake effect and/or further reduce the propellant gas plume.

Figure 12:
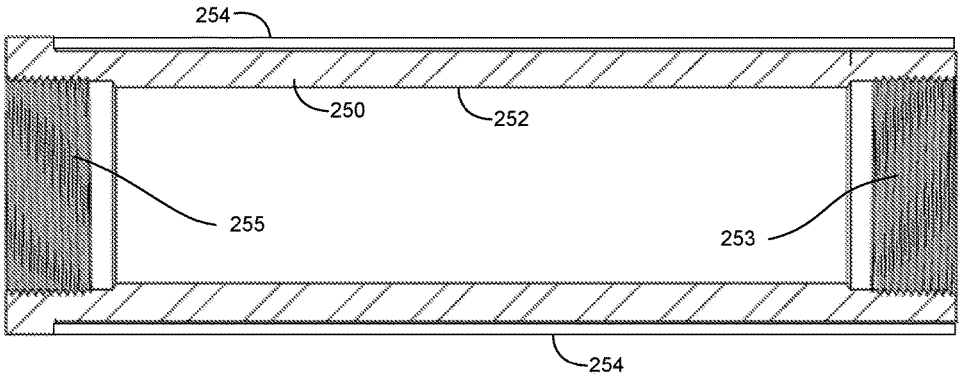
FIG. 12 is a cross-sectional view of an outer tube included in the flash suppressor shown in FIG. 10.

FIG. 12 is a cross-sectional view, showing additional details of the outer tube 250 and associated outer sleeve 254. As can be seen in FIG. 12, the outer tube 250 includes outer tube threads 255 at the proximal end, and outer tube threads 253 at the opposite end of the outer tube 250. As discussed above, the outer tube threads 255 are configured to engage with the base cap outer threads 224, and the outer tube threads 253 are configured to engage with the end cap outer threads 218. The inner surface 152 of the outer tube 150 may be a smooth cylindrical surface. However, as discussed further herein, other embodiments may include contours on other outer tubes' inner surfaces.

The outer tube 250 may be configured to prevent gas from escaping from the flash suppressor along all or part of the burn chamber 270. For example, the outer tube 250 may be constructed of a piece of pipe without any venting between the outer tube threads 255 and 253.

Figure 13:
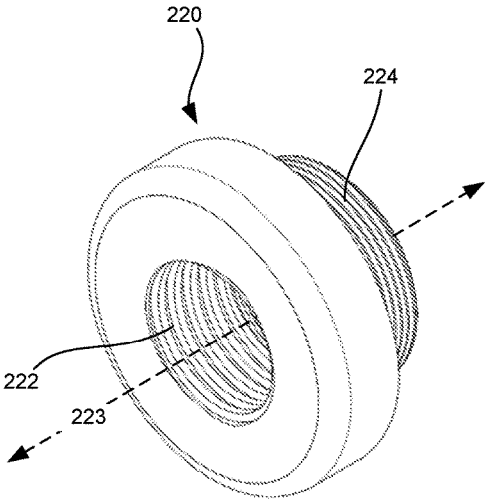
FIG. 13 is an isometric perspective view of a base cap included in the flash suppressor shown in FIG. 10.

FIG. 13 is an isometric perspective view of base cap 220. As shown in FIG. 13, base cap 220 includes base cap outer threads 224, and base cap interior threads 222 disposed in the base cap opening 223. Base cap outer threads 224 are configured to engage with the outer tube threads 255, and base cap interior threads 222 are configured to engage with muzzle brake attachment threads 24.

Figure 14:
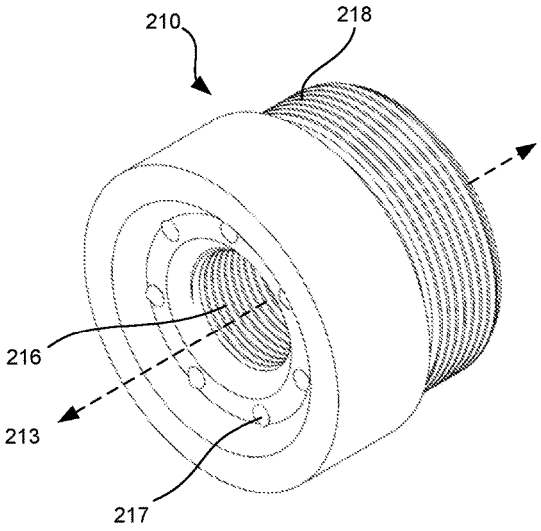
FIG. 14 is an isometric perspective view of an end cap included in the flash suppressor shown in FIG. 10.

FIG. 14 is an isometric perspective view of end cap 210. As shown in FIG. 14, end cap 210 includes end cap outer threads 218, and end cap interior threads 216 disposed in end cap opening 213. End cap outer threads 218 are configured to engage with the outer tube threads 253, and end cap interior threads 216 are configured to engage with inner tube threads 235. End cap 210 also includes a plurality of end cap ports 217, which allow propellant gas to exit the flash suppressor 200 via burn chamber 270. Positioning these ports 217 in a recessed portion of the end cap 210, facing away from the user, can be advantageous in many ways, including shielding the shooter's eyes from any remaining light plume, and directing the report sound away from the shooter's ears. In some examples, the openings of end cap ports 217 may be chamfered, e.g. to disperse the propellant gas, or directionally shaped, e.g. to guide the propellant gas toward, or away from, the end cap opening 213.

FIG. 15 is an expanded cross-sectional view of inner tube 230. As shown in FIG. 15, the inner tube 230 includes stabilizing portion 236, in this case an annular groove around the proximal end of the inner tube. Inner tube 230 further includes inner tube threads 235 configured to engage with end cap interior threads 216. As can also be seen in FIG. 15, inner tube 230 includes ribbed surfaces 238 and 239. As mentioned above, these surfaces can beneficially induce turbulent flow in the propellant gas to promote rapid burning of the propellant material within the burn chamber, thereby significantly reducing the amount of burning propellant gas that exits the flash suppressor.

FIG. 16 is an isometric perspective view of the inner tube 230. As shown in FIG. 16, the overall width of the inner tube 230 gradually decreases along the length of the ribbed surface 238 (notwithstanding the recessed ribs included therein), thereby expanding the portion of the burn chamber surrounding this portion. The overall width of the inner tube 230 remains approximately constant along the length of the ribbed surface 239 (notwithstanding the recessed ribs included therein).

Figure 17:
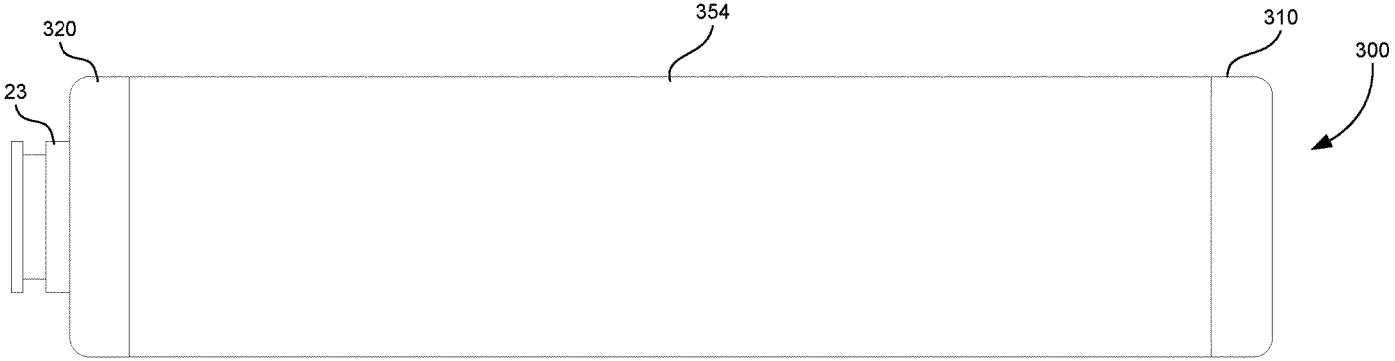
FIG. 17 depicts an exterior view of another exemplary flash suppressor according to aspects of the invention.

Turning to FIG. 17, yet another exemplary firearm flash suppressor 300 is shown. The flash suppressor 300 includes an outer tube 350, an end cap 310 at the distal end of the flash suppressor, and a base cap 320 at the proximal end of the flash suppressor. The muzzle brake attachment lip 23 from the muzzle brake 20, shown in FIGS. 1-3, can also be seen extending from the base cap 320 of the flash suppressor in FIG. 17.

Figure 18:
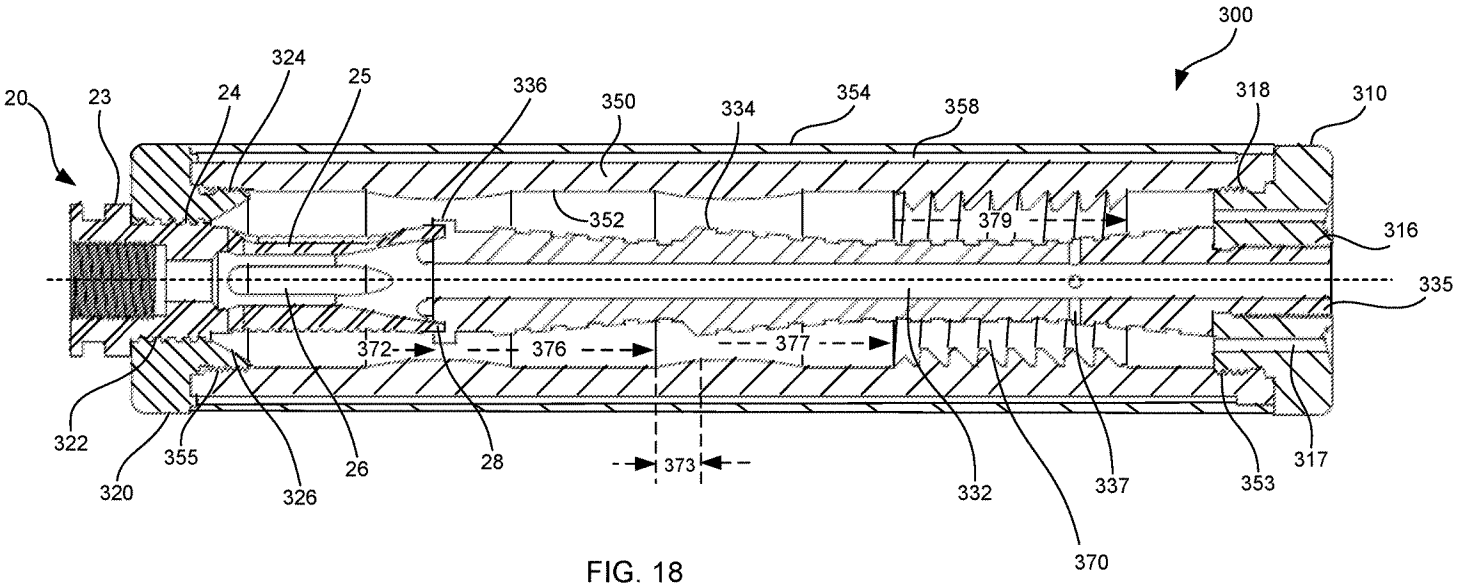
FIG. 18 is a cross-sectional view including further details of the exemplary flash suppressor shown in FIG. 17.

FIG. 18 is a cross-sectional view of the flash suppressor 300 shown in FIG. 17. As can be seen in FIG. 18, the flash suppressor 300 is attached to the muzzle brake 20 via base cap inner threads 322 that engage with the muzzle brake attachment threads 24. Base cap 320 may further include base cap outer threads that are configured to engage with outer tube threads 355. The base cap 320 may further include internal surfaces, e.g. inward of the outer tube threads 355, that are shaped to direct propellant gasses escaping from the muzzle brake 20 in a forward direction, into the burn chamber 370. For example, a beveled opening 326 of the base cap 320 may be configured so that propellant gas is directed from the muzzle brake side ports 26 toward the burn chamber narrowing portion 372.

The flash suppressor 300 includes an inner tube 330 that engages with the muzzle brake distal end 28 via an annular (or otherwise shaped) groove in stabilizing portion 336. The inner tube 330 includes a passage 332 through which a bullet can pass through and out of the distal end of the flash suppressor 300. In embodiments, the passage 332 can be a smooth bore that allows the bullet to pass through the flash suppressor without the turbulence, internal shock waves, or other destabilizing effects of a bullet passing by the ports, internal baffles and/or chambers of some conventional sound and/or flash suppressors.

The engagement of the stabilizing portion 336 with the muzzle brake distal end 28 helps ensure alignment of the passage 232 and the bore of the firearm, even when the inner tube 230 is heated during firing. The inventors have found that such features are important, particularly with longer flash suppressors such as shown in FIG. 17, because as the inner tube heats up during firing, there is a risk of the tube "drooping" out of perfect alignment with the muzzle bore, which can result in a catastrophic failure as the bullet impacts rather than travels through the inner tube.

The flash suppressor 300 further includes an end cap 310 that is secured to the outer tube 350 via outer tube threads 353 and end cap outer threads 318. The end cap 310 is also secured to the inner tube 330 via inner tube threads 335 and end cap interior threads 316. Securely lodging the inner tube 330 against the distal end 28 of the muzzle brake 20, or other rigid platform, can be achieved via compression applied, for example, by the end cap 310.

Thus, the exemplary flash suppressor 300 shown in FIG. 18 can also be implemented using only four components that are relatively easy to manufacture, assemble and disassemble. Such configurations may also avoid the use of baffles, or other objects connected to or engaged with the inner surface 352 of the outer tube 350 and/or the inner surface 352 of the outer tube 350.

In some examples, an outer sleeve 354 may be provided around the outer tube 350. The outer sleeve 354 (and any insulation 358 disposed between the outer sleeve 354 and outer tube 350) may help maintain the exterior of the flash suppressor at a safe temperature, e.g. to avoid burns, and/or reduce the heat signature of the firearm.

In some examples, an outer sleeve such as 254 or 354 may be drilled, or otherwise patterned with voids, ridges and/or recesses, to act as a heat sink for the flash suppressor. In some cases, the insulation 358, or void between outer tube 250 and outer sleeve 254, may be replaced or filled with a thermally conductive material/layer that transfers heat from the outer tube 250, 350 to the outer sleeve 254, 354. In other cases, an air gap may be present between the outer tube 250 and the outer sleeve 254, or between the outer tube 350 and the outer sleeve 354.

Unlike previous examples, the inner surface 352 of the outer tube 350 is contoured to provide areas of differing thickness, which can be used to further alter the cross-sectional area of the burn tube 370 along the length of the flash suppressor 300, as described further below. The different wall thicknesses can be achieved in numerous way, including direct patterning of the outer tube 350, using inserts, and/or otherwise forming the desired contour inside of a cylindrical pipe.

Between the inner surface 352 of the outer tube 350 and the outer surface 334 of the inner tube 330 is a void 370 which may also be referred to as a "burn chamber." As with the embodiments described above, during operation of the flash suppressor 300, propellant gas may exit the muzzle brake side ports 26 and enter the burn chamber 370 as the bullet exits the muzzle brake 20 and enters the passage 332 of the inner tube 330. The propellant gas travels past a first narrowing portion 372 and through a first expanding portion 376, and then travels past a second narrowing portion 373 and through a second expanding portion 377. In this regard, the inventors have found that the combination of multiple narrowing and expanding portions can be used to even further decrease the speed of the propellant gas traveling through the burn chamber 370, providing additional time for complete or near complete burning of the propellant gas. Additionally, in some embodiments, the narrowing and/or expanding portions may be differently sized. For example, the portion of the burn chamber defined by the first narrowing portion 372 and the first expanding portion 376 may be larger than the portion of the burn chamber defined by the second narrowing portion 373 and the second expanding portion 377.

In the example shown in FIG. 18, the overall thickness of inner tube 330 also changes over portions of the burn chamber. However, embodiments may also include configurations in which the thickness of inner tube 330 is constant or approximately constant, and changes in the burn chamber's cross-sectional area are caused solely by contour variations of the inner surface 352 of the outer tube 350.

The burn chamber 370 also includes a spiral portion 379, in which a spiral pattern 399 (winding around the inner tube 330) is formed on the inner surface 352 of the outer tube 350. Such features may be machined, or otherwise integrally formed, with the outer tube 350, or may use a separately formed material, such as an insert. In the spiral portion 379, swirling of the propellant gas is induced via the spiral contour on the inner surface 352 to even further facilitate mixture of the propellant gas and ambient oxygen. In embodiments the spiral pattern 399 included on the inner surface 352 may be configured not to touch the inner tube 330. As with certain other configurations described herein, it should be appreciated that the bullet traveling through the passage 332 is physically separated from, and undisturbed by the gasses flowing through spiral portion 379, with the exception of pressure equalization via inner tube ports 337, which may be located in other more distal positions or omitted entirely. Even with slight perturbations that may result from pressure equalization through inner tube ports 337, a bullet leaving the flash suppressor 300 can still be significantly more stable than a bullet leaving a conventional sound or flash suppressor with multiple ports, baffles and/or chambers that can cause myriad destabilizing micropressure increases and decreases.

It is also noted that a similar spiral contour may be included on outer surface 334 of the inner tube 330, with or without a corresponding spiral pattern 399 included on the inner surface 352 of the outer tube 350.

Figure 22:
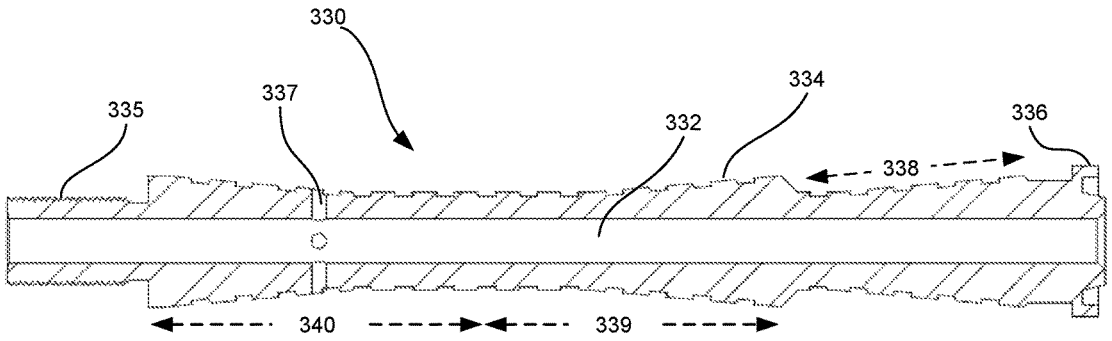
FIG. 22 is a cross-sectional view showing additional details of an inner tube included in the flash suppressor shown in FIG. 17.
Figure 23:
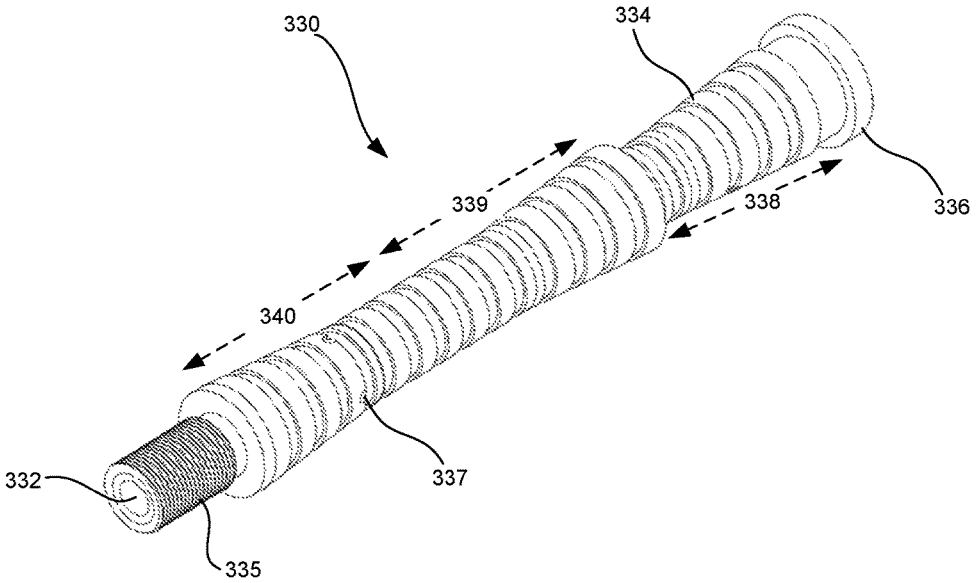
FIG. 23 is an isometric perspective view showing additional outer surface details of the inner tube shown in FIG. 22.

The inner tube 330 also includes a plurality of annular indentations or grooves on the outer surface 334, which can be seen more clearly and FIGS. 22 and 23. These grooves can facilitate, among other objects, disruption of the laminar flow of propellant gas, inducing turbulent flow and mixing of the propellant gas with ambient oxygen in the burn chamber.

As also shown in FIG. 18, the inner tube 330 may include one or more inner tube ports 337 that allow fluid communication between the passage 332 and the burn chamber 370. Such ports can be advantageous in equalizing pressure as the bullet passes the ports 337 and exits the flash suppressor at the distal end via opening 313 in the end cap.

In some embodiments, inner tube ports 337 may be relocated to a more distal position, e.g. between the spiral portion 337 and the end cap 310.

End cap 310 may also include one or more end cap ports 317 in fluid communication with the burn chamber 370 that allow propellant gas to exit the burn chamber 370. As with the previously described embodiments, the distal ends of the end cap ports may be chamfered, or otherwise shaped to further control the propellant gas, such as dispersing and/or directing it to provide a muzzle brake effect and/or further reduce the propellant gas plume.

Figure 19:
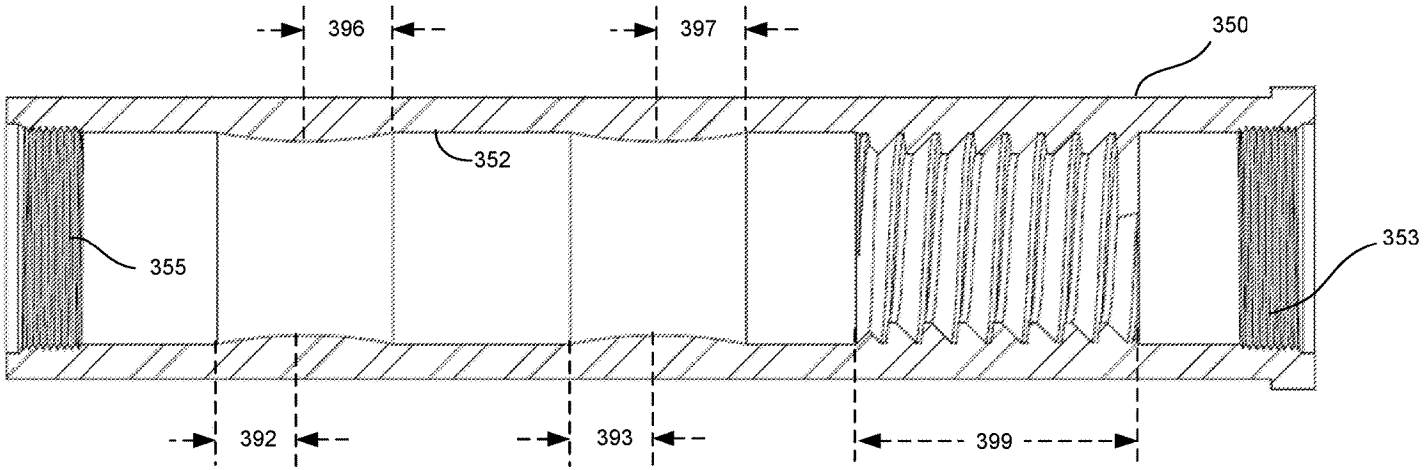
FIG. 19 is a cross-sectional view of an outer tube included in the flash suppressor shown in FIG. 17.

FIG. 19 is a cross-sectional view, showing additional details of the outer tube 350. As can be seen in FIG. 19, the outer tube 350 includes outer tube threads 355 at the proximal end, and outer tube threads 353 at the opposite end of the outer tube 350. As discussed above, the outer tube threads 355 are configured to engage with the base cap outer threads 324, and the outer tube threads 353 are configured to engage with the end cap outer threads 318. The inner surface 352 of the outer tube 350 may be contoured to provide a plurality of outer tube thickening and thinning regions that may narrow and expand the cross-sectional area of the burn chamber, respectively. For example, the outer tube 350 includes thickening regions 392 and 393 where the thickness of the outer tube 350 increases in the distal direction. Outer tube 350 also includes thinning regions 396 and 397 where the thickness of the outer tube 350 decreases in the distal direction. These surface contours, along with longitudinal changes in the outer surface 334 of the inner tube 330, provide for the narrowing (372, 373) and expanding (376, 377) portions of the burn chamber 370 shown in FIG. 18. FIG. 19 also shows the spiral pattern 399, on the inner surface 352 of the outer tube 350, that forms the spiral portion 379 of the burn chamber 370.

In some embodiments, a spiral pattern like 399 may be used independently of any narrowing and/or expanding portions, effectively relying on the swirling of the propellant gas to mix and burn the gas before exiting the flash suppressor. For example, a flash suppressor may include an outer tube with a spiral pattern like 399 and/or an inner tube with an outer surface that has a corresponding or counter-spiral pattern, that swirl the propellant gasses and enhance burning without the use of a narrowing and/or expanding portion as described above.

The outer tube 350 may be configured to prevent gas from escaping from the flash suppressor 300 along all or part of the burn chamber 370. For example, the outer tube 350 may be constructed of a piece of pipe without any venting between the outer tube threads 355 and 353.

Figure 20:
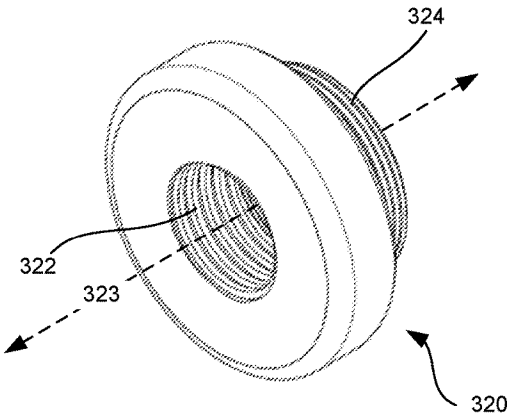
FIG. 20 is an isometric perspective view of a base cap included in the flash suppressor shown in FIG. 17.

FIG. 20 is an isometric perspective view of base cap 320. As shown in FIG. 20, base cap 320 includes base cap outer threads 324, and base cap interior threads 322 disposed in the base cap opening 323. Base cap outer threads 324 are configured to engage with the outer tube threads 355, and base cap interior threads 322 are configured to engage with muzzle brake attachment threads 24.

Figure 21:
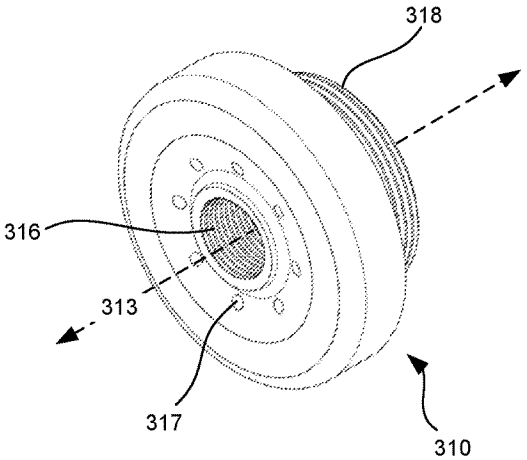
FIG. 21 is an isometric perspective view of an end cap included in the flash suppressor shown in FIG. 17.

FIG. 21 is an isometric perspective view of end cap 310. As shown in FIG. 21, end cap 310 includes end cap outer threads 318, and end cap interior threads 316 disposed in end cap opening 313. End cap outer threads 318 are configured to engage with the outer tube threads 353, and end cap interior threads 316 are configured to engage with inner tube threads 335. End cap 310 also includes a plurality of end cap ports 317, which allow propellant gas to exit the flash suppressor 300 via burn chamber 370. Positioning these ports 317 in a recessed portion of the end cap 310, facing away from the user, can be advantageous in many ways, including shielding the shooter's eyes from any remaining light plume, and directing the report sound away from the shooter's ears. In some examples, the openings of end cap ports 317 may be chamfered, e.g. to disperse the propellant gas, or directionally shaped, e.g. to guide the propellant gas toward, or away from, the end cap opening 313.

FIG. 22 is an expanded cross-sectional view of inner tube 330. As shown in FIG. 22, the inner tube 330 includes stabilizing portion 336, in this case an annular groove around the proximal end of the inner tube. Inner tube 330 further includes inner tube threads 335 configured to engage with end cap interior threads 316. As can also be seen in FIG. 22, inner tube 330 includes ribbed surfaces 338, 339 and 340. As mentioned above, these surfaces can beneficially induce turbulent flow in the propellant gas to promote rapid burning of the propellant material within the burn chamber, thereby significantly reducing the amount of burning propellant gas that exits the flash suppressor.

FIG. 23 is an isometric perspective view of the inner tube 330. As shown in FIG. 23, the overall width of the inner tube 230 gradually decreases along the length of the ribbed surface 338 (notwithstanding the recessed ribs included therein), thereby expanding the surrounding portion 376 of the burn chamber 370. The overall width of the inner tube 230 also gradually decreases along the length of the ribbed surface 339 (notwithstanding the recessed ribs included therein), thereby expanding the surrounding portion 377 of the burn chamber 370. The overall width of the inner tube 230 then gradually increases along the length of the ribbed surface 340 (notwithstanding the recessed ribs included therein), thereby narrowing the surrounding portion of the burn chamber 370, including parts of the spiral portion 379.

Although many of the connections described herein have used threaded coupling, embodiments may include any form of joining that are known in the art. For example, parts may be joined together using clamps, cams, teeth and slots, compression fittings, etc. In some cases, parts may be permanently or semi-permanently joined together such as by welding, brazing, epoxying, or other means that may effectively prevent a user from disassembling the flash suppressor or its constituent parts.

Any feature of any embodiment discussed herein may be combined with any feature of any other embodiment discussed herein in some examples of implementation, unless otherwise specified.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

While the foregoing is directed to embodiments of the present invention, other and further embodiments of the invention may be devised without departing from the basic scope thereof, and the scope thereof is determined by the claims that follow.

What is claimed is:

1. A firearm flash suppressor, comprising:

a proximal end configured to attach the flash suppressor to at least one of a firearm muzzle, a flash hider, or a muzzle brake;

a distal end comprising a first opening for allowing a bullet to exit the flash suppressor and a second opening for allowing gas to exit the flash suppressor;

an inner tube disposed between the proximal end and the distal end, and including a passage configured to allow the bullet to travel through the flash suppressor; and an outer tube disposed between the proximal end and the distal end, and at least partially surrounding the inner tube, wherein, an outer surface of the inner tube and an inner surface of the outer tube at least partially define a burn chamber configured to allow burning of a gas exiting from the at least one of a firearm muzzle, a flash hider, or a muzzle brake, and wherein, at least one of the outer surface of the inner tube or the inner surface of the outer tube includes a contour that changes a cross-sectional area of the burn chamber, and wherein a thickness of the outer tube changes over a length of the burn chamber, the change in thickness of the outer tube at least partially causing a reduction and expansion of the cross-sectional area of the burn chamber.

2. The flash suppressor of claim 1, wherein the proximal end comprises a base cap configured to attach to a standard fitting included in the at least one of a firearm muzzle, a flash hider, or a muzzle brake, and configured to attach to and detach from the outer tube.

3. The flash suppressor of claim 1, wherein the proximal end is configured to attach to a muzzle brake, and gas enters the flash suppressor via side ports included in the muzzle brake.

4. The flash suppressor of claim 1, wherein the distal end comprises an end cap configured to attach to and detach from the outer tube, the end cap including an outlet port configured to allow gas from the burn chamber to exit the flash suppressor.

5. The flash suppressor of claim 4, wherein the inner tube is configured to attach to and detach from the end cap via threading within the first opening.

6. The flash suppressor of claim 1, wherein the inner tube is configured to seat securely against the at least one of a firearm muzzle, a flash hider, or a muzzle brake, and to fixedly align center axes of the passage and the at least one of a firearm muzzle, a flash hider, or a muzzle brake.

7. The flash suppressor of claim 1, wherein the passage of the inner tube has a substantially uniform cross-section.

8. The flash suppressor of claim 6, wherein a thickness of the inner tube also changes over a length of the burn chamber, the change in thickness of the inner tube also at least partially causing the reduction and expansion of the cross-sectional area of the burn chamber.

9. The flash suppressor of claim 1, further comprising a sleeve at least partially surrounding the outer tube, and an insulating material disposed between the sleeve and the outer tube.

10. The flash suppressor of claim 1, wherein at least one of the outer surface of the inner tube or the inner surface of the outer tube includes a ribbed surface.

11. The flash suppressor of claim 1, wherein the burn chamber includes a spiral contour configured to swirl gas passing through the burn chamber.

12. The flash suppressor of claim 1, wherein the burn chamber is free of baffles.

13. A firearm flash suppressor, comprising:

an inner tube including a passage configured to allow a bullet to travel through the flash suppressor;

an outer tube configured to at least partially surround the inner tube and to form a burn chamber between the inner tube and the outer sleeve;

a base cap attached to the outer tube and configured to attach the flash suppressor to at least one of a firearm muzzle, a flash hider, or a muzzle brake; and an end cap attached to the outer tube and the inner tube, the end cap including an exhaust port in fluid communication with the burn chamber for allowing gas to exit the flash suppressor, wherein, the inner tube is configured to seat securely against the at least one of a firearm muzzle, a flash hider, or a muzzle brake, and to fixedly align center axes of the passage and the at least one of a firearm muzzle, a flash hider, or a muzzle brake, wherein, the passage of the inner tube has a substantially uniform cross-section, and a thickness of at least one of the inner tube or the outer tube changes over a length of the burn chamber to change a cross-sectional area of the burn chamber, and wherein the base cap is removably attached to the outer tube via a first set of cooperating threads included in the base cap and the outer tube, the end cap is removably attached to the outer tube via a second set of cooperating threads included in the end cap and the outer tube, and the end cap is removably attached to the inner tube via a third set of cooperating threads included in the end cap and the inner tube.

14. The flash suppressor of claim 13, wherein the base cap is configured to attach to a muzzle brake, and includes at least one inlet port configured to allow gas from the muzzle brake to enter the burn chamber.

15. The flash suppressor of claim 13, wherein the thickness of the inner tube changes over the length of the burn chamber.

16. The flash suppressor of claim 13, wherein the thickness of the outer tube changes over the length of the burn chamber.

17. The flash suppressor of claim 13, wherein the thicknesses of the inner tube and the outer tube both change over the length of the burn chamber.

18. The flash suppressor of claim 13, wherein the outer tube includes a solid cylindrical wall and does not allow gas to escape from or enter the burn chamber.

19. A firearm flash suppressor, comprising:

an inner tube including a passage configured to allow a bullet to travel through the flash suppressor;

an outer tube configured to at least partially surround the inner tube and to form a burn chamber between the inner tube and the outer tube;

a base cap attached to the outer tube and configured to attach the flash suppressor to at least one of a firearm muzzle, a flash hider, or a muzzle brake; and an end cap attached to the outer tube and the inner tube, wherein, the inner tube is configured to seat securely against the at least one of a firearm muzzle, a flash hider, or a muzzle brake, and to fixedly align center axes of the passage and the at least one of a firearm muzzle, a flash hider, or a muzzle brake, and wherein, the passage of the inner tube has a substantially uniform cross-section, and a thickness of the inner tube changes over a length of the burn chamber to change a cross-sectional area of the burn chamber, and wherein an outer surface of the inner tube includes a plurality of circumferential ridges disposed at different locations along the length of the burn chamber.

20. The flash suppressor of claim 19, wherein a thickness of the outer tube is substantially uniform along the length of the burn chamber.

21. The flash suppressor of claim 19, wherein the outer tube includes a solid cylindrical wall and does not allow gas to escape from or enter the burn chamber.

* * * * *